United States Patent [19]

Wojcik et al.

[11] 4,374,462

[45] Feb. 22, 1983

[54] DECONTAMINATION APPARATUS

[75] Inventors: Thaddeus A. Wojcik, Salem Township, Westmoreland County; Richard M. Kobuck, Delmont; Ronald F. Antol, North Huntingdon, all of Pa.

[73] Assignee: Westinghouse Electric Corp., Pittsburgh, Pa.

[21] Appl. No.: 63,324

[22] Filed: Aug. 2, 1979

[51] Int. Cl.[3] ..... B24C 3/32

[52] U.S. Cl. ..... 51/411

[58] Field of Search ..... 51/410, 411, 320; 118/317; 239/237

[56] References Cited

U.S. PATENT DOCUMENTS

| | | | |
|---|---|---|---|
| Re. 27,612 | 4/1973 | Ruppel | 239/227 |
| 1,613,638 | 1/1927 | Altimari | 51/411 |
| 3,778,938 | 12/1973 | Korn | 51/320 |
| 3,895,756 | 7/1975 | Jaeger | 118/317 |
| 4,219,976 | 9/1980 | Burack | 57/411 |

OTHER PUBLICATIONS

"Harmonic Drive", USM Corporation, Wakefield, MA.

*Primary Examiner*—Nicholas P. Godici
*Attorney, Agent, or Firm*—L. A. DePaul

[57] ABSTRACT

Apparatus for decontaminating radioactive components comprising an attachment mechanism for completely suspending the apparatus from the tube sheet of a nuclear steam generator, a first drive mechanism for moving the apparatus in a first direction, a second drive mechanism for pivoting the apparatus in a second direction, and a third drive mechanism for moving the apparatus in a third independent direction. The apparatus also comprises a dual nozzle arrangement attached to the third drive mechanism for directing a water-grit mixture toward the component to be decontaminated. The apparatus provides a mechanism for remotely decontaminating the channel head of a nuclear steam generator so as to allow working personnel to enter therein.

4 Claims, 4 Drawing Figures

DECONTAMINATION APPARATUS

CROSS-REFERENCES TO RELATED APPLICATIONS

This application is related to copending application Ser. No. 930,091 filed Aug. 1, 1978 in the name of R. D. Burack et al., entitled "DECONTAMINATION MACHINE AND METHOD FOR DECONTAMINATING NUCLEAR STEAM GENERATOR CHANNEL HEAD" now U.S. Pat. No. 4,219,976 and copending application Ser. No. 029,598 filed Apr. 12, 1979 in the name of R. T. Marchese, entitled "DECONTAMINATION METHOD", both of which are assigned to the assignee of the present application.

BACKGROUND OF THE INVENTION

This invention relates to decontamination apparatus and more particularly to apparatus for decontaminating components of nuclear power plants.

During the operation of nuclear power plants and similar apparatus, certain components become exposed to radiation and may develop a thin radioactive film on the surface of the component. From time to time, it is necessary to either inspect or repair these components of the nuclear reactor power plant. During the inspection or repair of the components, it is necessary for working personnel to enter the component or to be stationed in close proximity to the component whereby working personnel may be exposed to radiation emitted from the contaminated component. In some circumstances, the radiation field emitted from these components is such that a worker would receive the maximum permissible radiation dose in less than five minutes of working time. Such a situation means that a given worker may spend only a relatively short amount of time working on the inspection or the repair operation of the nuclear component. Having each worker spend a relatively short amount of time in the repair or inspection procedure, necessitates the use of many workers with each worker working a short time period in order to accomplish the desired procedure. While this may be an acceptable practice for minor inspections or repair procedures, this is not an acceptable practice where there is an extensive inspection or an extensive repair job to be performed. Where the procedure to be performed is a time-consuming procedure, it is likely that an unusually large number of highly trained personnel would be necessary to carry out the task. Such a situation may not only be unacceptable from a financial aspect, but may also be unacceptable from a manpower level aspect. Therefore, what is needed is a decontamination apparatus that reduces the radiation field in components of nuclear reactor power plants so that working personnel may perform operations thereon.

SUMMARY OF THE INVENTION

Apparatus for decontaminating radioactive components comprises an attachment mechanism for completely suspending the apparatus from the tube sheet of a nuclear steam generator, a first drive mechanism for moving the apparatus in a first direction, a second drive mechanism for pivoting the apparatus in a second direction, and a third drive mechanism for moving the apparatus in a third independent direction. The apparatus also comprises a dual nozzle arrangement attached to the third drive mechanism for directing a water-grit mixture toward the component to be decontaminated.

The apparatus provides a mechanism for remotely decontaminating the channel head of a nuclear steam generator so as to allow working personnel to enter therein.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

During operation of a typical nuclear power plant, certain components of the nuclear power plant such as the nuclear steam generators, become radioactively contaminated. Since certain repair or inspection operations that must be performed periodically on the nuclear power plant components require working personnel to be present in or near the components, it is important that the radiation field associated with the component be at a level that is compatible with the presence of working personnel for an extended period of time. The invention, described herein, is apparatus for decontaminating nuclear steam generators so that working personnel may perform operations therein.

Figure 1:
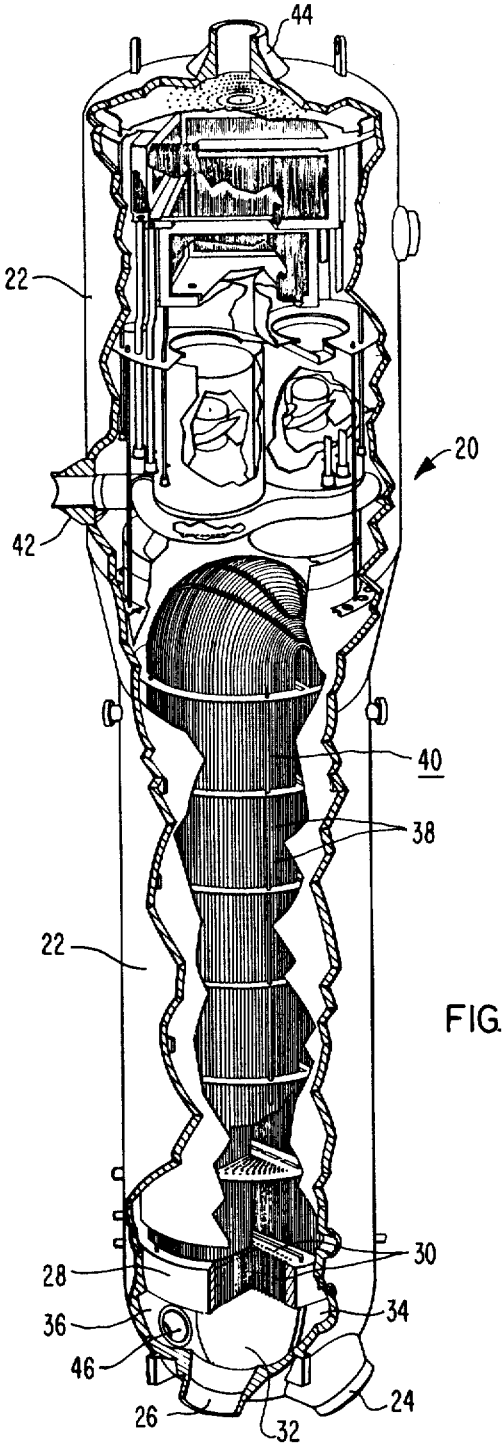
FIG. 1 is a cross-sectional view in elevation of a typical nuclear steam generator.

Referring to FIG. 1, a nuclear steam generator referred to generally as 20, comprises an outer shell 22 with a primary fluid inlet nozzle 24 and a primary fluid outlet nozzle 26 attached thereto near its lower end. A generally cylindrical tube sheet 28 having tube holes 30 therein is also attached to outer shell 22 near its lower end. A dividing plate 32 attached to both tube sheet 28 and outer shell 22 defines a primary fluid inlet plenum 34 and a primary fluid outlet plenum 36 in the lower end of the steam generator as is well understood in the art. Tubes 38 which are heat transfer tubes shaped with a U-like curvature are disposed within outer shell 22 and attached to tube sheet 28 by means of tube holes 30. Tubes 38 which may number about 7,000 form a tube bundle 40. In addition, a secondary fluid inlet nozzle 42 is disposed on outer shell 22 for providing a secondary fluid such as water while a steam outlet nozzle 44 is attached to the top of outer shell 22. In operation, primary fluid which may be water having been heated by circulation through the nuclear reactor core enters steam generator 20 through primary fluid inlet nozzle 24 and flows into primary fluid inlet plenum 34. From primary fluid inlet plenum 34 the primary fluid flows upwardly through tubes 38, in tubesheet 28, up through the U-shaped curvature of tube 38, down through tubes 38 and into primary fluid outlet plenum 36 where the primary fluid exits the steam generator through primary fluid outlet nozzle 26. While flowing through tubes 38, heat is transferred from the primary fluid to the secondary fluid which surrounds tubes 38 causing the secondary fluid to vaporize. The resulting steam then exits the steam generator through steam outlet nozzle 44. On occasion, it is necessary to inspect or repair tubes 38 or the welds between tubes 38 and tubesheet 28 to ensure that the primary fluid which may contain radioactive particles remains isolated from the secondary fluid. Therefore, manways 46 are provided in outer shell 22 to provide access to both primary fluid inlet plenum 34 and primary fluid outlet plenum 36 so that access may be had to the entire tube sheet 28.

Figure 2:
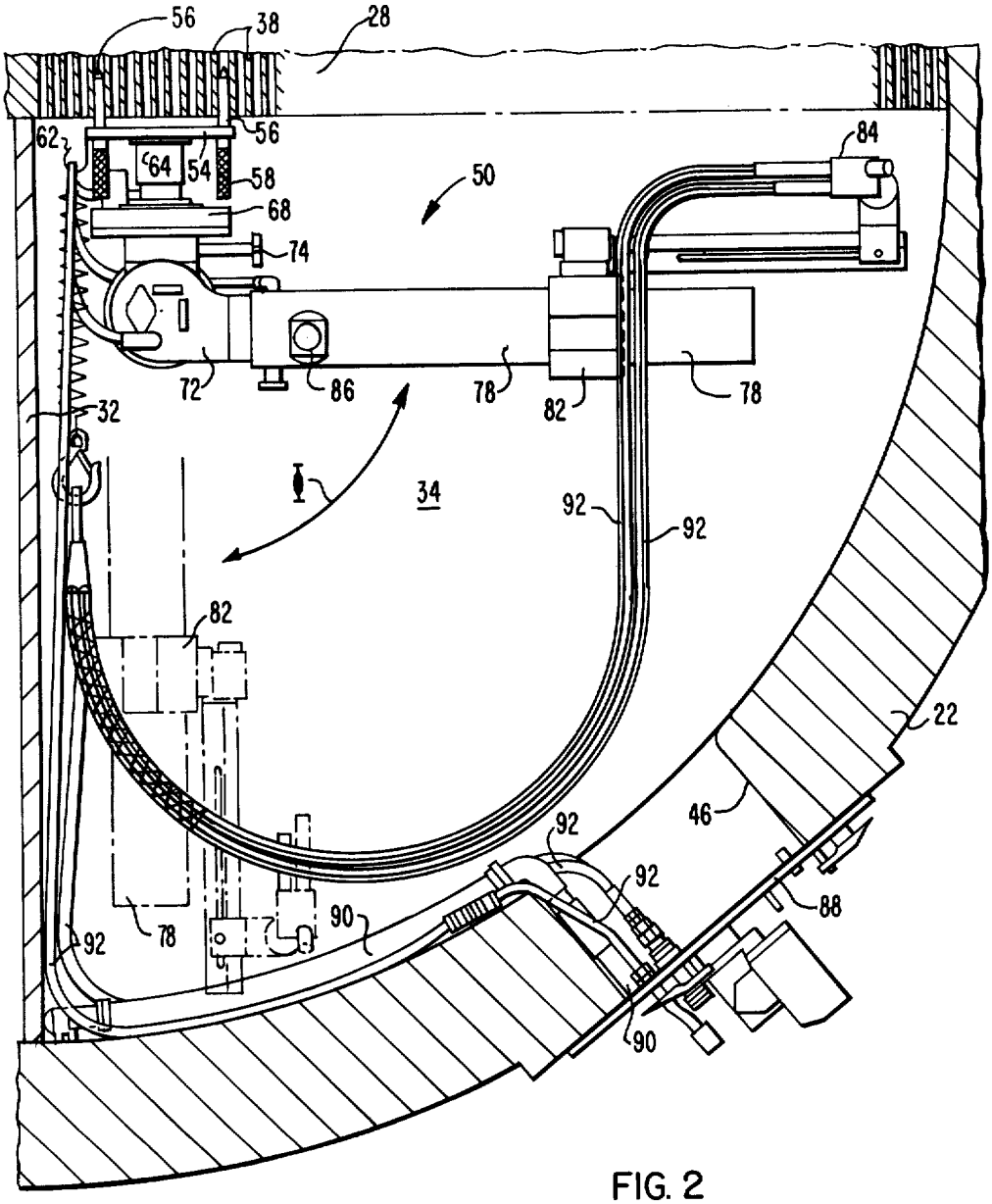
FIG. 2 is a view in elevation of the apparatus disposed in a nuclear steam generator.
Figure 3:
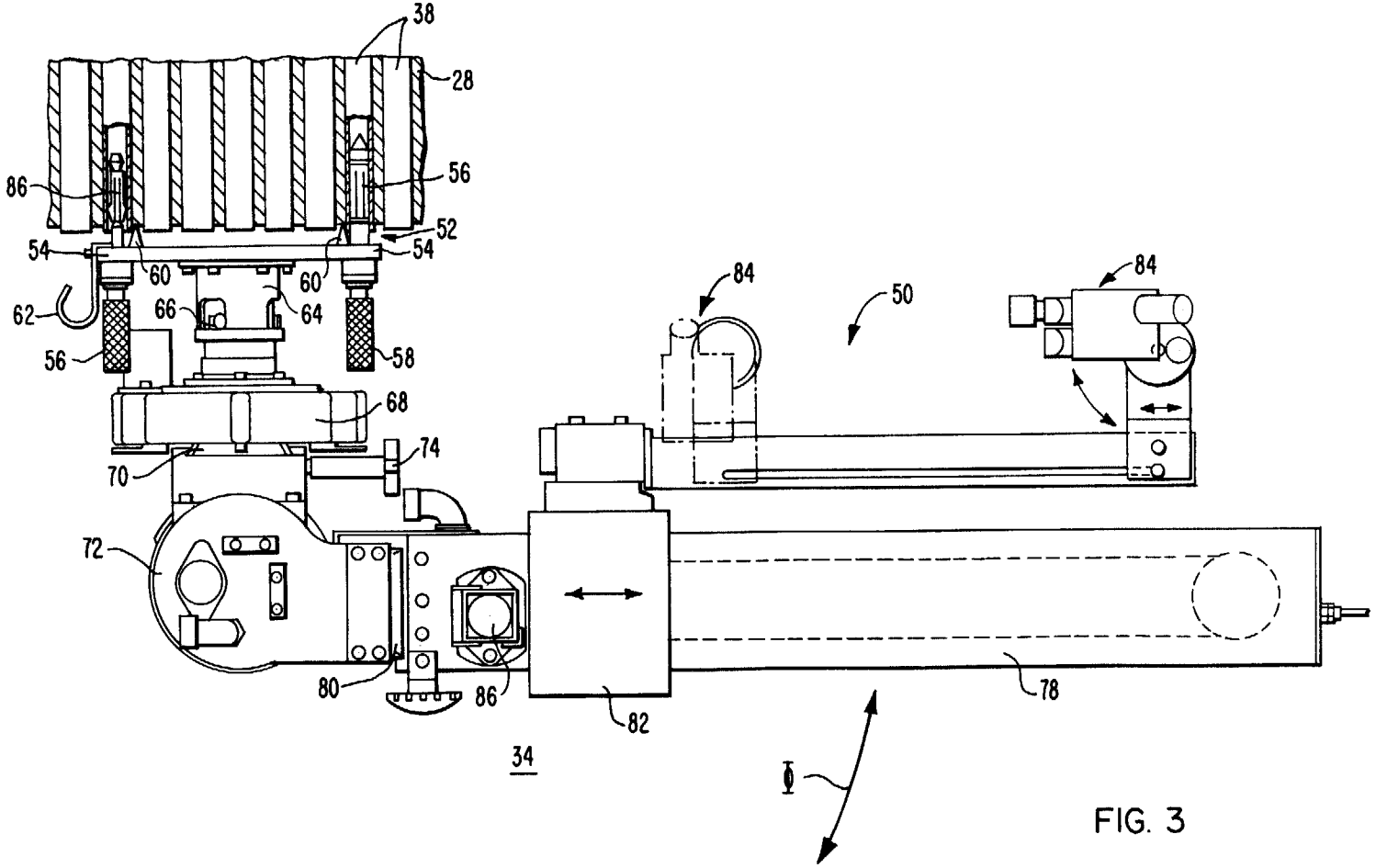
FIG. 3 is a view in elevation of the apparatus showing its attachment to the tube sheet of a nuclear steam generator.
Figure 4:
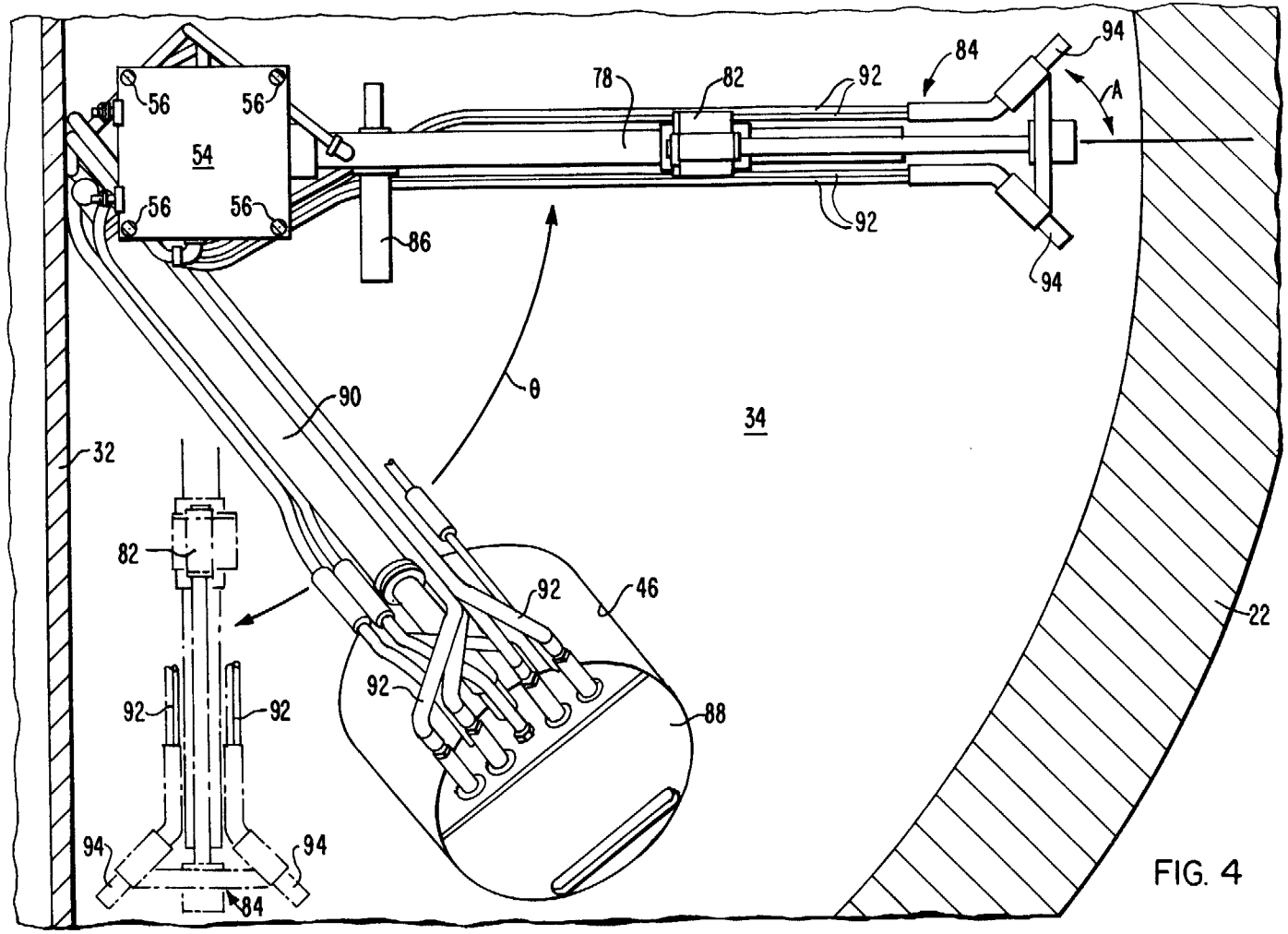
FIG. 4 is a plan view of the apparatus disposed in a plenum of a nuclear steam generator.

Referring now to FIGS. 2, 3, and 4, the decontamination apparatus is referred to generally as 50 and comprises an attachment mechanism 52 for completely supporting decontamination apparatus 50 from tube sheet 28. Attachment mechanism 52 comprises a support plate 54 having camlocks 56 disposed therein. Camlocks 56 which may be chosen from those well known in the art are capable of being inserted into tubes 38 of tube sheet 28 and are capable of expanding into contact with the internal surfaces of tubes 38 to thereby support support plate 54 therefrom. Camlocks 56 are equipped with handles 58 on the lower end thereof so that working personnel may enter nuclear steam generator 20 such as through manway 46 and insert camlocks 56 into tubes 38. The working personnel may manually turn handles 58 so as to expand camlocks 56 into contact with the internal surfaces of tubes 38. Of course, camlocks 56 may be equipped with remote control devices which could remotely actuate camlocks 56. Support plate 54 has a plurality of guide pins 60 attached to the top surface thereof for contacting tube sheet 28 so as to align support plate 54 in a parallel orientation with tube sheet 28. A hook 62 is also attached to support plate 54 for supporting various conduits. A first support member 64 is attached to the underside of support plate 54 for providing an attachment mechanism for other components of decontamination apparatus 50. First support member 64 has a first locking mechanism 66 which may be a breach lock disposed on its lower end for providing an attachment mechanism for first drive mechanism 68. First drive mechanism 68 may be a DC motor attached to a harmonic drive mechanism for rotating decontamination apparatus 50 in a horizontal plane parallel to tube sheet 28 and generally referred to as the $\theta$ direction. First drive mechanism 68 has a first dovetail attachment 70 on its lower end for providing attachment to second drive mechanism 72. First dovetail attachment 70 may be locked in place by turning locking knob 74 which actuates a gripper mechanism 76 that firmly contacts first dovetail attachment 70 thereby holding second drive mechanism 72 thereto. Second drive mechanism 72 may be a harmonic drive chosen from those well known in the art such as one from the USM Corporation. Second drive mechanism 72 provides a means by which decontamination apparatus 50 may be rotated in a plane substantially perpendicular to tube sheet 28 and generally referred to as the $\phi$ direction. A support arm 78 is attached to second drive mechanism 72 by a second dovetail attachment 80 which is similar to first dovetail attachment 70. A nozzle support 82 is mounted on support arm 78 and serves to support nozzle configuration 84. A third drive mechanism 86 which may be a chain and sprocket arrangement is disposed in support arm 78 and attached to nozzle support 82 for moving nozzle support 82 in a direction along support arm 78.

Still referring to FIGS. 2–4, a temporary closure 88 is bolted to manway 46 so as to isolate the interior of inlet plenum 34 from outside thereof where working personnel may be present. A suction hose 90 is disposed in the bottom of inlet plenum 34 and extends through closure 88 to a waste removal and recirculation system that may be chosen from those well known in the art. At least four conduits 92 extend through closure 88 and into inlet plenum 34. Conduits 92 serve to conduct a water-grit mixture to nozzles 94 of nozzle configuration 84. Conduits 92 also serve to provide electrical connections to the various drive mechanisms of decontamination apparatus 50. Nozzle configuration 84, comprises at least two nozzles 94 and are generally arranged at an angle A from the center line of support arm 78 and as shown in FIG. 4. Angle A may be approximately between 30° to 70° and preferably be an angle of approximately 45°. Nozzles 94 may be chosen from those well known in the art such as a "Dynajector" manufactured by the Aqua-Dyne Engineering, Inc. of Houston, Texas. A separate water and a separate grit conduit 92 are connected to each of nozzles 94 so that the water and grit are mixed at nozzle 94 and emitted from nozzle 94. Nozzle configuration 84 is also arranged so as to be pivotable in the vertical plane as shown in phantom in FIG. 2. The movements of the first drive mechanism 68, second drive mechanism 72, and third drive mechanism 86 along with the pivotal capability of nozzle configuration 84 provide the capability of allowing nozzles 94 to reach all of the locations of tube sheet 28, and the inner surface of inlet plenum 34 along with divider plate 32. This capability allows the water-grit mixture to be emitted from nozzles 94 and to impinge upon all of the surfaces of the primary fluid inlet plenum 34. Decontamination apparatus 50, therefore, provides a mechanism for directing a decontamination mixture onto the surfaces of primary fluid inlet plenum 34 for removing the contamination thereon.

OPERATION

When it is desired to decontaminate the inlet or outlet plenum of a nuclear steam generator, the nuclear steam generator is first deactivated and drained of its water. Next the normal manway cover is removed which allows access through manway 46 into, for example, primary fluid inlet plenum 34. An inflatable nozzle cover is then installed on the inside of the plenum which prevents the water-grit mixture from entering the primary piping. Working personnel then temporarily enter primary fluid inlet 34 and insert camlocks 56 of support plate 54 into tubes 38 as shown in the Figures. Camlocks 56 are then locked into place by means of handles 58. Next, working personnel attach first drive mechanism 68 to first support member 64 by means of first locking mechanism 66. Once first drive mechanism 68 has thus been attached to attachment mechanism 52, second drive mechanism 72 is attached to first drive mechanism 68 by means of first dovetail attachment 70. First dovetail attachment 70 is then locked in place by means of locking knob 74. Next, support arm 78 is attached to second drive mechanism 72 by means of second dovetail attachment 80 and similarly locked in place. At this point, conduits 92 are connected to the various locations on decontamination apparatus 50 and suction hose 90 is placed in the bottom of inlet plenum 34. Closure 88 is then bolted to shell 22 around manway 46 thereby isolating the inside of shell 22 from the outside thereof and thereby preventing the water-grit mixture containing contaminants from exiting the nuclear steam generator. As can be seen, decontamination apparatus 50 may be easily mounted in the nuclear steam generator 20 and is capable of positioning nozzles 94 at various locations in the inlet or outlet plena of the nuclear steam generator so as to be able to carry out the decontamination process.

With decontamination apparatus 50 installed on the tube sheet 28 as previously described, water is introduced through two of the conduits 92 at a pressure between approximately 2,000 psi and approximately 2,700 psi. The water flow rate at this pressure should be approximately 8 to 9 gallons per minute through each of the nozzles 94. Several types of grit may be used for mixing with the water such as alumina or magnetite. However, the grit size should be approximately 120 to 325 mesh size in accordance with U.S. Sieve Series Mesh Sizes. It is important to note that the grit concentration in the water spray should be approximately 3% to approximately 7% by weight. In order to provide effective decontamination without excessive material deterioration, it is important that the nozzles 94 by placed approximately 6 inches to 10 inches from the surface of the steam generator 20. It has also been found that nozzles 94 should be arranged at approximately between 30° to 70° with respect to the longitudinal axis of support arm 78 so that the water-grit mixture impinges the surface of the steam generator 20 at approximately between a 30° to 70° angle and preferably at about 45°. With each nozzle 94 arranged at approximately 6 to 10 inches from the surface of either tube sheet 28, dividing plate 32, or outer shell 22, a pump is activated which causes water to be pumped from the water supply through at least two conduits 92 and into nozzles 94. The flow of the water through nozzle 94 creates a vacuum in nozzle 94 which draws the grit from a grit supply through another conduit 92 where it mixes with the water in nozzle 94. The water-grit mixture is then directed toward the particular part of the steam generator 20. Simultaneously, either first drive mechanism 68, second drive mechanism 72, or third drive mechanism 86 are activated so as to cause a sweep of the water-grit mixture along a selected path of area to be decontaminated. Thus, nozzles 94 move in a line across the particular part of steam generator 20 and at a speed of approximately 1 foot per minute to approximately 3 feet per minute. The speed of travel of nozzles 94 is correlated with the water-grit flow rate so as to provide effective decontamination without excessive deterioration of the metal. The water-grit mixture impinges on the surface of the steam generator 20 and removes a thin oxide layer from the metal which is carried away by the water-grit mixture and collected in the bottom of inlet plenum 34 where it is removed by means of suction hose 90. Once nozzles 94 have made a complete pass of the particular area of the steam generator, one of the other drive mechanisms is advanced so as to index nozzles 94 to a new location so that a new pass may be made on the steam generator. In this manner, an entire sweeping of tube sheet 28, divider plate 32, and the inside of shell 22 may be made.

From the above description taken in conjunction with the accompanying drawings, one can see that by placing nozzle configuration 84 in the position as shown in phantom in FIG. 2 and by using selective movements of first drive mechanism 68 and third drive mechanism 86, the bottom surface of tube sheet 28 may be decontaminated using this process. Similarly, with nozzle configuration 84 as shown in full in FIG. 2, and with selected movements of first drive mechanism 68 and second drive mechanism 72, nozzles 94 may be swept in the $\phi$ direction as shown in phantom in FIG. 2 and may thus sweep the entire inside surface of outer shell 22. In addition, with nozzle configuration 84 arranged as shown in phantom in FIG. 2, and with nozzles 94 directed toward divider plate 32 by means of rotation of first drive mechanism 68, then by activation of third drive mechanism 86 divider plate 32 may be decontaminated. Therefore, it can be seen that the various combinations of movements of first drive mechanism 68, second drive mechanism 72, and third drive mechanism 86 together with placement of nozzle configuration 84 provides a means by which substantially all of the interior of primary fluid inlet plenum 34 may be decontaminated so that working personnel may enter therein and perform operations on the steam generator 20.

Analysis has determined that with the use of the decontamination apparatus, it is likely that less than 0.001 inches of metal surface will be removed from the steam generator. It also appears that the use of an alumina grit on Iconel metal will remove a metal layer of less than 0.0002–0.0003 inches and that the use of a magnitite grit on stainless steel will remove a metal layer of less than 0.0005–0.0001 inches. Therefore, the invention provides decontamination apparatus for lowering the radiation field of nuclear reactor power components so that working personnel may enter the component and perform operations thereon.

We claim as our invention:

1. Decontamination apparatus for decontaminating radioactive nuclear steam generators comprising:

an attachment mechanism attached to a tube sheet of said nuclear steam generator for completely suspending said decontamination apparatus therefrom;

a first support member attached to the under side of said attachment mechanism;

a harmonic first drive mechanism attached to said first support member for rotating said decontamination apparatus in a horizontal plane parallel to said tube sheet;

a harmonic second drive mechanism attached to said first drive mechanism for rotating said decontamination apparatus in a plane substantially perpendicular to the plane of said tube sheet;

a support arm attached to said second drive mechanism;

a nozzle support mounted on said support arm;

at least two nozzles mounted on said nozzle support and arranged at between approximately 30° to 70° from the center line of said support arm;

a chain and sprocket third drive mechanism disposed in said support arm and attached to said nozzle support for moving said nozzle support and said nozzles in a direction along said support arm, said drive mechanisms providing a means of locating said nozzles near the various surfaces of said nuclear steam generator while maintaining said nozzles approximately 6 to 10 inches from said surfaces; and water-grit supply means connected to said nozzles for supplying a water-grit mixture to said nozzles at a pressure between approximately 200 psi and 2700 psi and with said water grit-mixture having a grit concentration of approximately 3% to 7% by weight, said nozzles directing said water-grit mixture toward the surface of said nuclear steam generator and thus decontaminating said nuclear steam generator.

2. The apparatus according to claim 1 wherein said nozzles are arranged at approximately 45° from the center line of said support arm.

3. The apparatus according to claim 2 wherein said apparatus further comprises a suction hose disposed in said nuclear steam generator for removing the contaminated products from said component.

4. The apparatus according to claim 3 wherein said attachment mechanism comprises a support plate having at least four camlocks disposed herein for supporting said support plate from said tube sheet and having a plurality of guide pins disposed thereon for aligning said support plate with said tube sheet.

* * * * *